US007028447B2

(12) United States Patent
Sung

(10) Patent No.: US 7,028,447 B2
(45) Date of Patent: Apr. 18, 2006

(54) PACKAGE PAPER THERMAL PRINTER OF TABLET PACKING MACHINE

(75) Inventor: Tae-Hwan Sung, Kuro-Ku (KR)

(73) Assignees: JVM Co., Ltd., Daegu (KR); EOdigitek Co., Ltd., Seoul (KR)

( * ) Notice: Subject to any disclaimer, the term of this patent is extended or adjusted under 35 U.S.C. 154(b) by 0 days.

(21) Appl. No.: 10/979,325

(22) Filed: Nov. 3, 2004

(65) Prior Publication Data

US 2005/0115200 A1 Jun. 2, 2005

(30) Foreign Application Priority Data

Nov. 28, 2003 (KR) ..... 10-2003-0085386

(51) Int. Cl.
*B65B 61/26* (2006.01)

(52) U.S. Cl. ..... 53/131.5; 53/568

(58) Field of Classification Search ..... 53/131.5
See application file for complete search history.

(56) References Cited

U.S. PATENT DOCUMENTS 3,887,056 A * 6/1975 Lehmann ..... 400/196
4,077,187 A * 3/1978 Paxton ..... 53/131.5
4,490,963 A * 1/1985 Knudsen ..... 53/559
4,493,178 A * 1/1985 Buckner et al. ..... 53/131.5
5,441,589 A * 8/1995 Groswith et al. ..... 156/542
5,839,257 A * 11/1998 Soderstrom et al. ..... 53/411
6,041,574 A * 3/2000 Bennett ..... 53/411
6,216,418 B1 * 4/2001 Kim ..... 53/131.5
6,742,317 B1 * 6/2004 Cronauer et al. ..... 53/411

* cited by examiner

*Primary Examiner*—John Sipos
(74) *Attorney, Agent, or Firm*—Oblon, Spivak, McClelland, Maier & Neustadt, P.C.

(57) ABSTRACT

A package paper thermal printer of a tablet packing machine for printing information about prescription medicines on package paper by a thermal print head and a ribbon tape, so that the information is very easily printed and the patient can easily recognize the information. The paper package thermal printer includes a supporting frame mounted in the case and formed with a mounting hole, an actuating plate installed at the mounting hole, guide rails installed at the actuating plate, guides installed at the mounting hole, and engaged with the guide rails so as to support the actuating plate, a driving motor installed at the supporting frame and having an eccentric cam coming in contact with an elevating roller so as to raise the actuating plate, wheels mounted at the actuating plate, a ribbon tape wound around the wheels fed by driving force transmitted from the motor, a contact roller installed at the supporting frame, and a thermal print head installed at the actuating plate, wherein the thermal print head and the ribbon tape are raised together so as to closely attach the ribbon tape to a lower surface of the package paper passing under the contact roller, so that information inputted into the thermal print head is transferred to the package paper by heat and characters are printed on the package paper when the actuating plate is raised.

3 Claims, 12 Drawing Sheets

PACKAGE PAPER THERMAL PRINTER OF TABLET PACKING MACHINE

BACKGROUND OF THE INVENTION

1. Field of the Invention

The present invention relates to a package paper thermal printer of a tablet packing machine, and more particularly to a package paper thermal printer of a tablet packing machine for printing information about prescription medicines on package paper by a thermal print head and a ribbon tape raised and lowered by an eccentric cam when the package paper wound around a reel is supplied between sealing rollers of a sealing device, so that the information is very easily printed and the patient can easily recognize the information about the prescription medicine.

2. Description of the Related Art

Generally, hospitals and the pharmacies are capable of providing medicine according to a medical doctor's prescription, distributing the medicine into package paper, and packing the medicine in the package paper. At present, the preparation and packaging of medicine is performed by an automatic tablet packing machine.

In the above tablet packing machine, medicine is dropped into a hopper by a medicine supplying device, and is inserted into the package paper folded into two parts. Cylindrical sealing rollers installed with heaters seal the package paper traveling therebetween, and form a cutting line on the package paper, so that the patient can be provided with the packaged prescription medicine.

However, since the tablet packing machine simply packages and provides the prescription medicines to the patient, various information, such as the medicine name, patient name, how to take the medicines or the like, is recorded or written by hand or other devices, separately.

Moreover, since the medicine name, the patient name, and how to take the medicine, or the like, must be recorded in accordance with every patient, and since the package paper wound around the reel is continuously traveled, it is very difficult to exactly record various information about the prescription medicines on the traveling package paper. Thus, a novel thermal printer capable of automatically printing information about the prescription medicines in the tablet packing machine is seriously demanded.

SUMMARY OF THE INVENTION

Therefore, the present invention has been made in view of the above and/or other problems, and it is an object of the present invention to provide a package paper thermal printer of a tablet packing machine for printing information about prescription medicines on package paper by a thermal print head and a ribbon tape raised and lowered by an eccentric cam when the package paper wound around a reel is supplied between sealing rollers of a sealing device, so that the information is very easily printed and the patient can easily recognize the information about the prescription medicine.

In accordance with the present invention, the above and other objects can be accomplished by the provision of a paper package thermal printer of an automatic tablet packing machine in which when tablets, accommodated in accommodating recesses formed at the upper side of a case enclosing inner components of the automatic tablet packing machine, are dropped into a hopper disposed under the accommodating recesses, and a package paper wound around a reel and folded in two by an idle roller and a folding member is traveled, the tablets are inserted into the folded package paper, the vertical sides and the top side of the folded package paper are sealed by heat, and the sealed vertical sides of the package paper are formed with cutting lines having a plurality of holes penetrated therethrough, while the package paper passes between cylindrical sealing rollers having heaters, so as to complete the packaging of the tablets.

The paper package thermal printer according to the present invention includes a supporting frame vertically mounted in the case and formed with a mounting hole, an actuating plate installed at the front side of the mounting hole, guide rails installed at sides of the actuating plate, guides installed at sides of the mounting hole, and engaged with the guide rails so as to support the actuating plate, a driving motor installed at a rear lower side of the supporting frame and having an eccentric cam coming in contact with an elevating roller mounted at a rear side of the actuating plate so as to raise the actuating plate, wheels mounted at front sides of the actuating plate, a ribbon tape wound around the wheels fed by driving force transmitted from the motor, a contact roller installed at a front upper portion of the supporting frame, and a thermal print head installed at a front upper portion of the actuating plate.

Preferably, the thermal print head and the ribbon tape disposed at the upper portion thereof are raised together so as to closely attach the ribbon tape to a lower surface of the package paper passing under the contact roller, so that information inputted into the thermal print head is transferred to the package paper by heat and characters are printed on the package paper when the actuating plate is raised.

BRIEF DESCRIPTION OF THE DRAWINGS

These and/or other objects and advantages of the present invention will become apparent and more readily appreciated from the following description of the embodiments, taken in conjunction with the accompanying drawings, in which.

DESCRIPTION OF THE PREFERRED EMBODIMENTS

Figure 1:
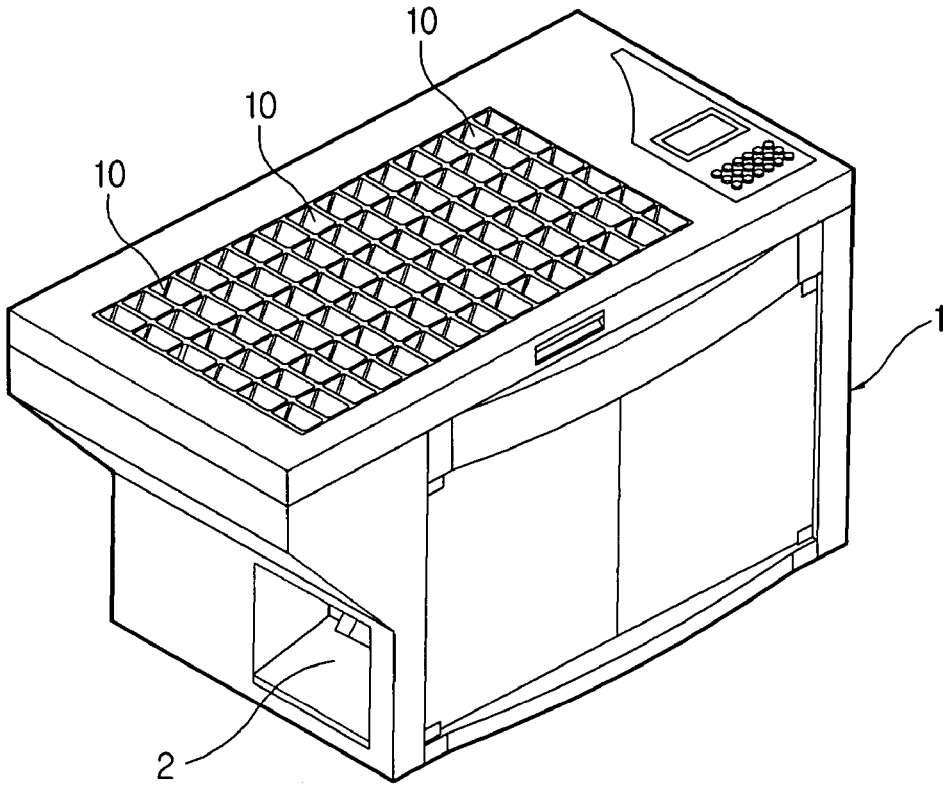
FIG. 1 is a perspective view illustrating an automatic tablet packing machine installed with a package paper thermal printer according to the present invention.
Figure 2:
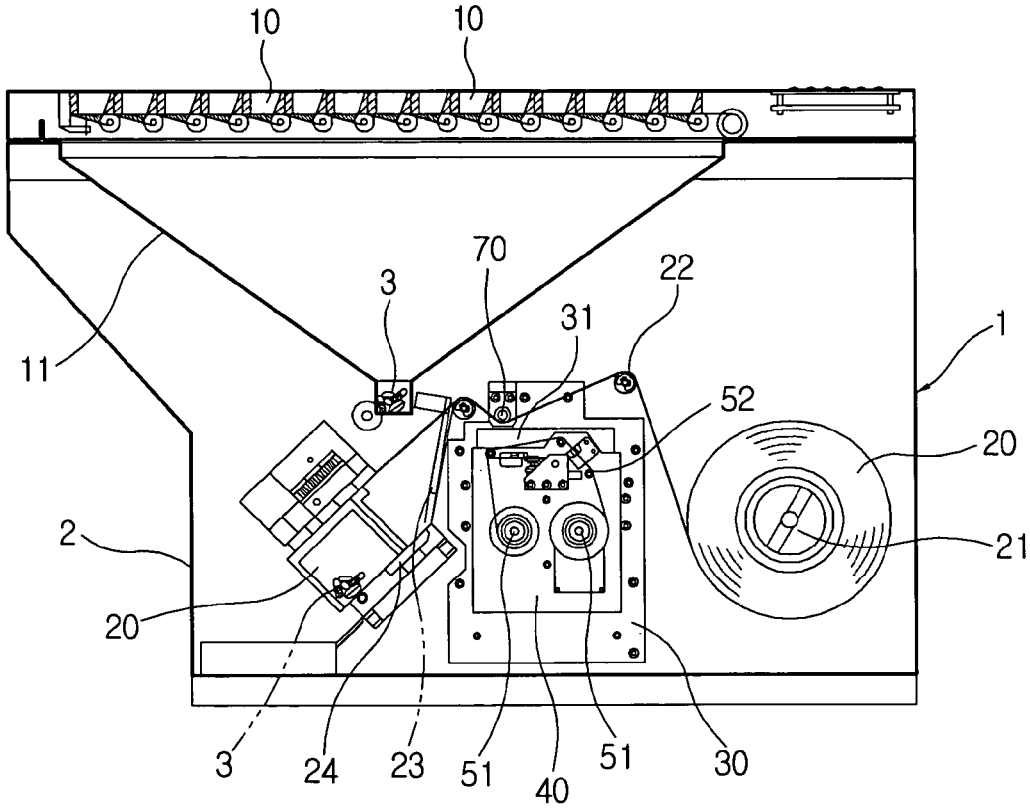
FIG. 2 is a cross-sectional view of the automatic tablet packing machine in FIG. 1.
Figure 3A:
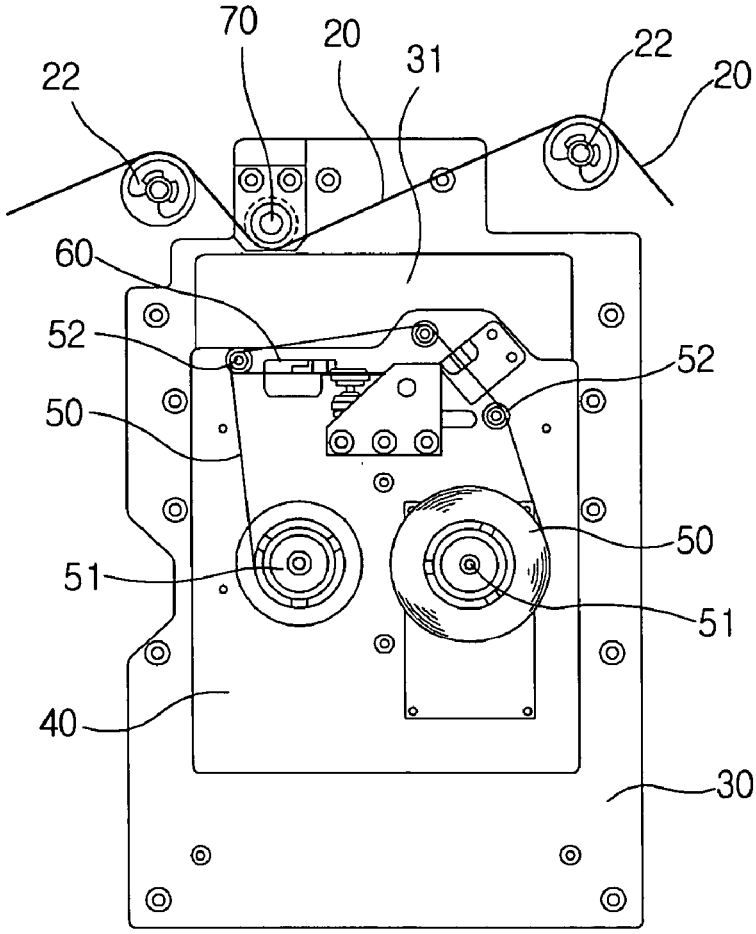
FIGS. 3*a* and 3*b* are front elevation views illustrating operation of the package paper thermal printer according to the present invention.
Figure 3B:
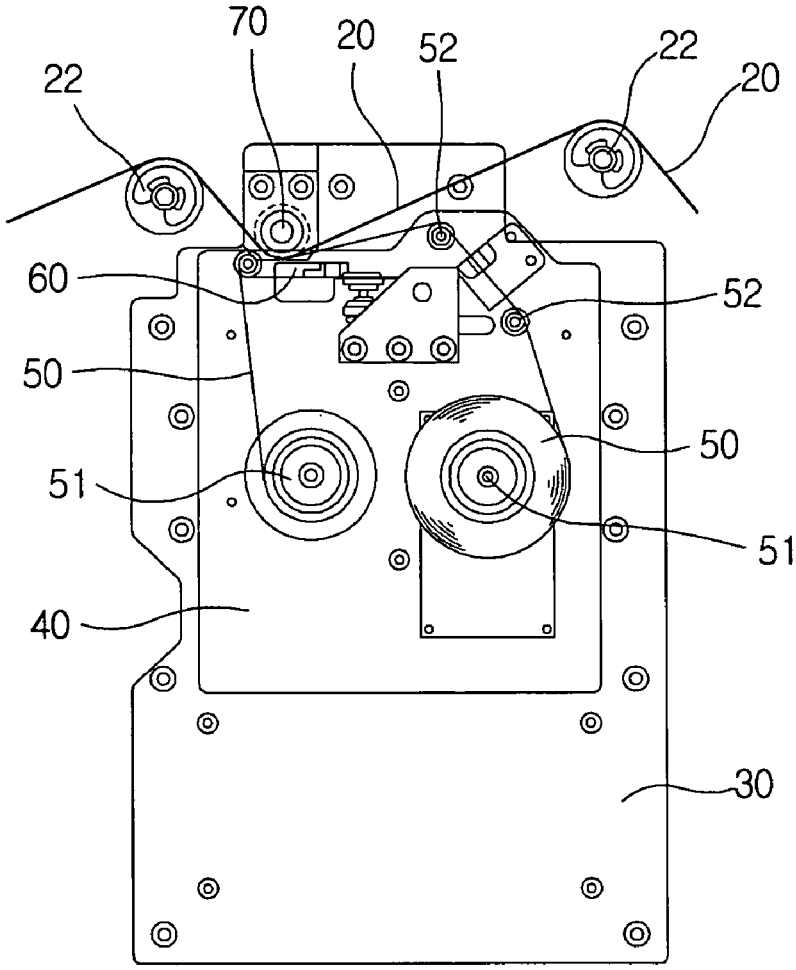
Figure 4A:
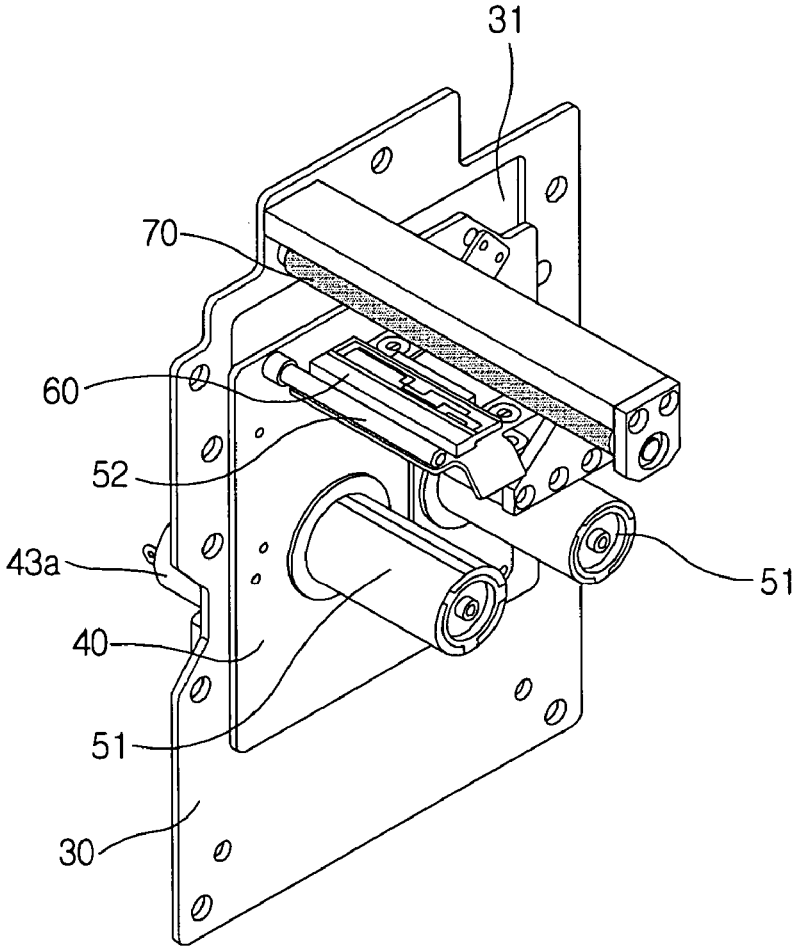
FIG. 4*a* is a perspective view illustrating the front side of the package paper thermal printer according to the present invention.
Figure 4B:
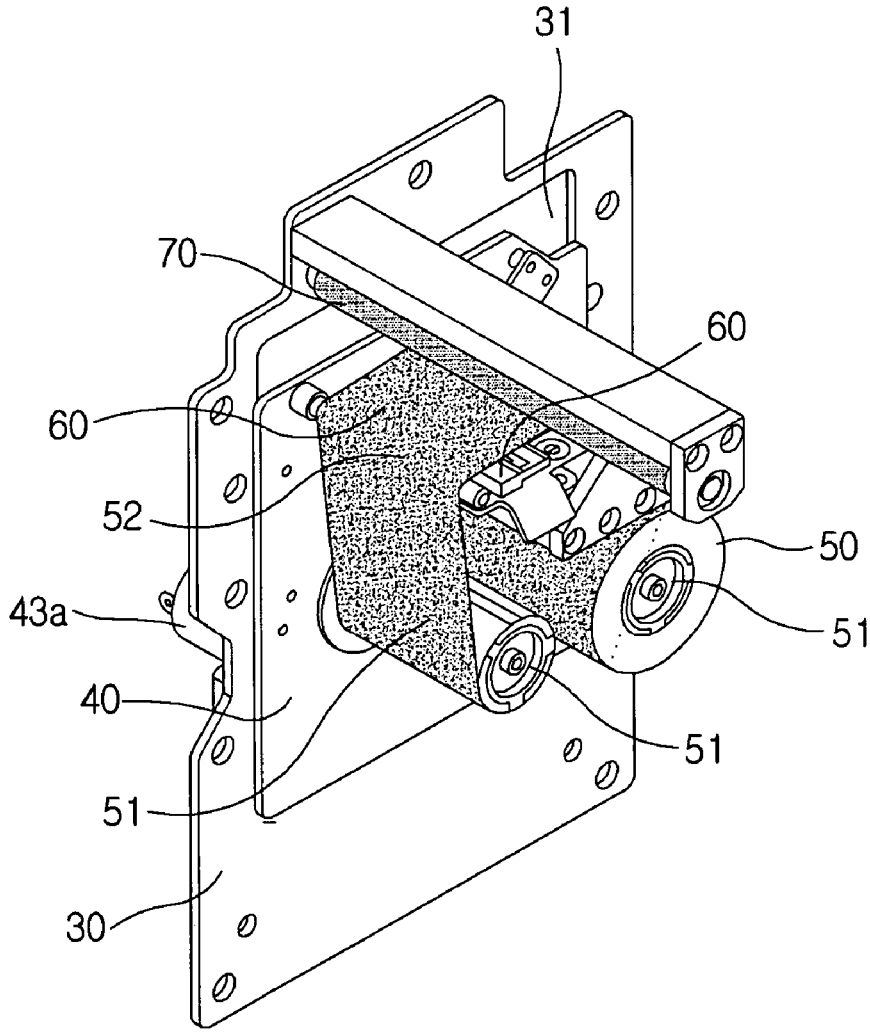
FIG. 4*b* is a perspective illustrating a state that a ribbon tape is installed to the package paper thermal printer in FIG. 4*a;*
Figure 5A:
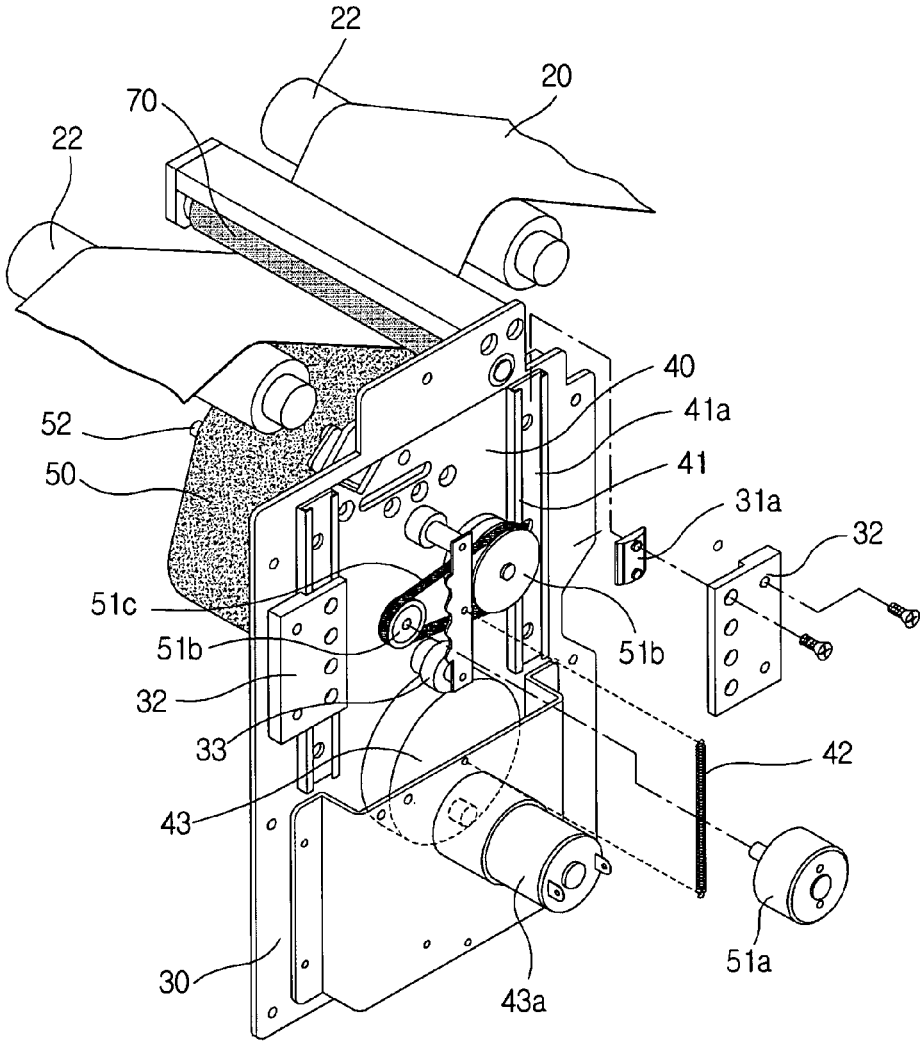
FIG. 5*a* is a partially exploded perspective view illustrating a rear side of the package paper thermal printer according to the present invention.
Figure 5B:
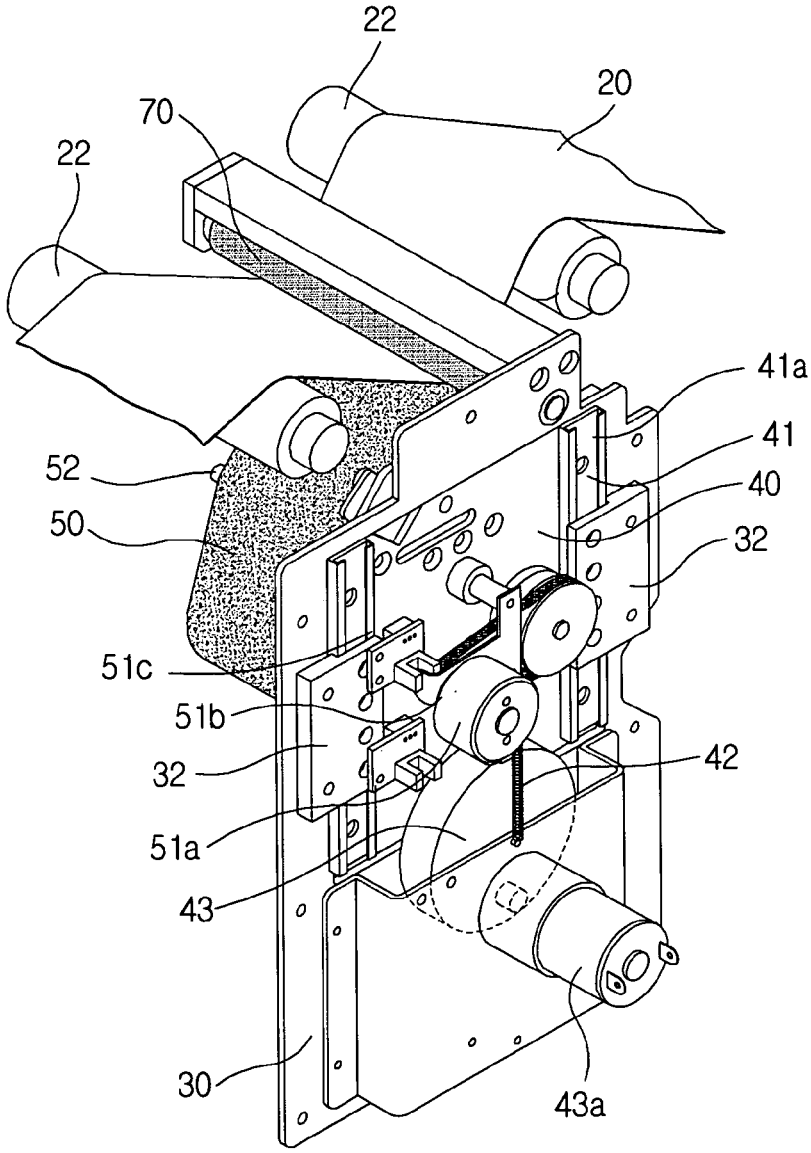
FIG. 5*b* is a perspective view illustrating the rear side of the package paper thermal printer according to the present invention.
Figure 6A:
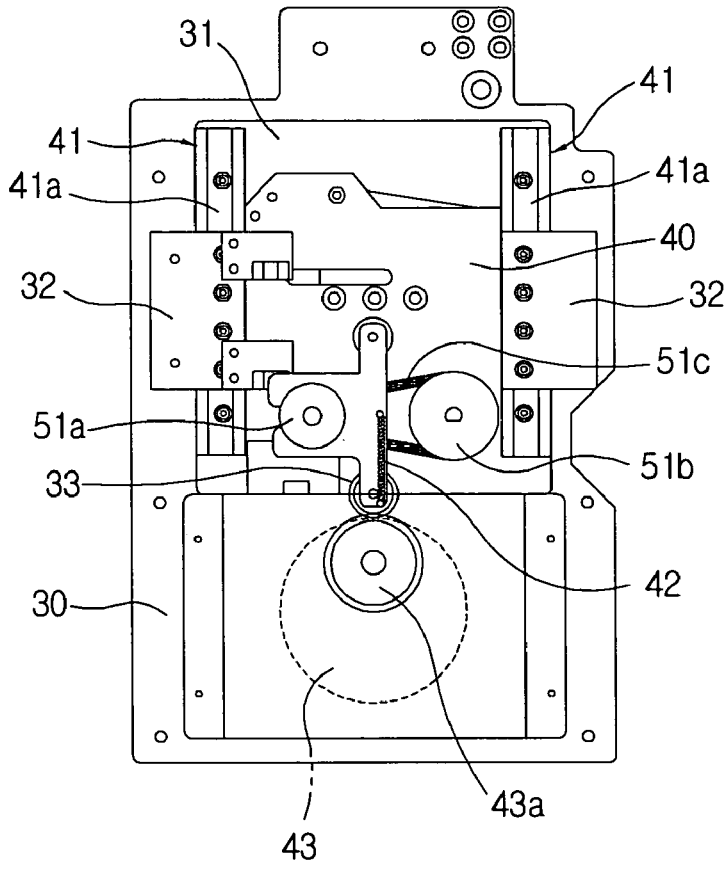
FIGS. 6*a* and 6*b* are rear views illustrating stepwise operation of the package paper thermal printer according to the present invention.
Figure 6B:
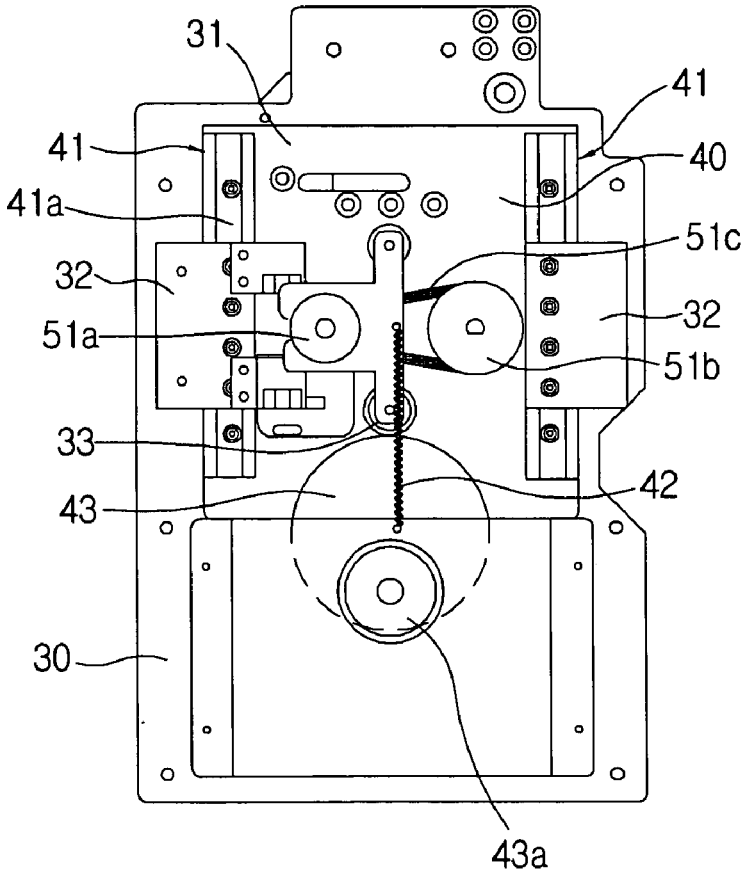
Figure 7:
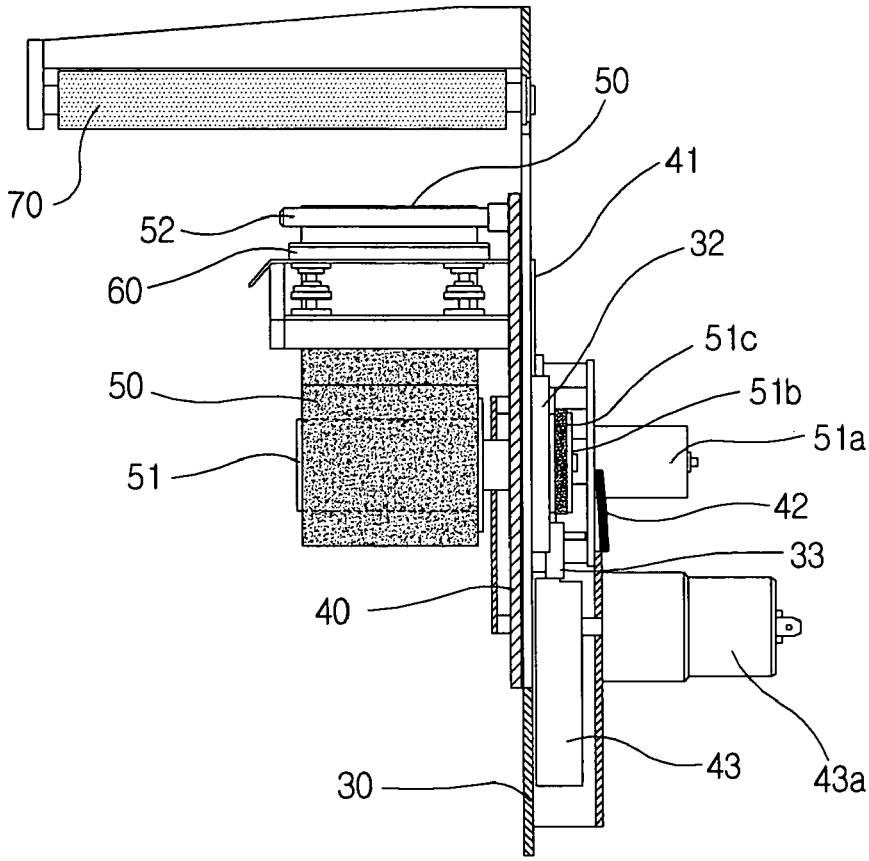
FIG. 7 is a side cross-sectional view of the package paper thermal printer according to the present invention.
Figure 8:
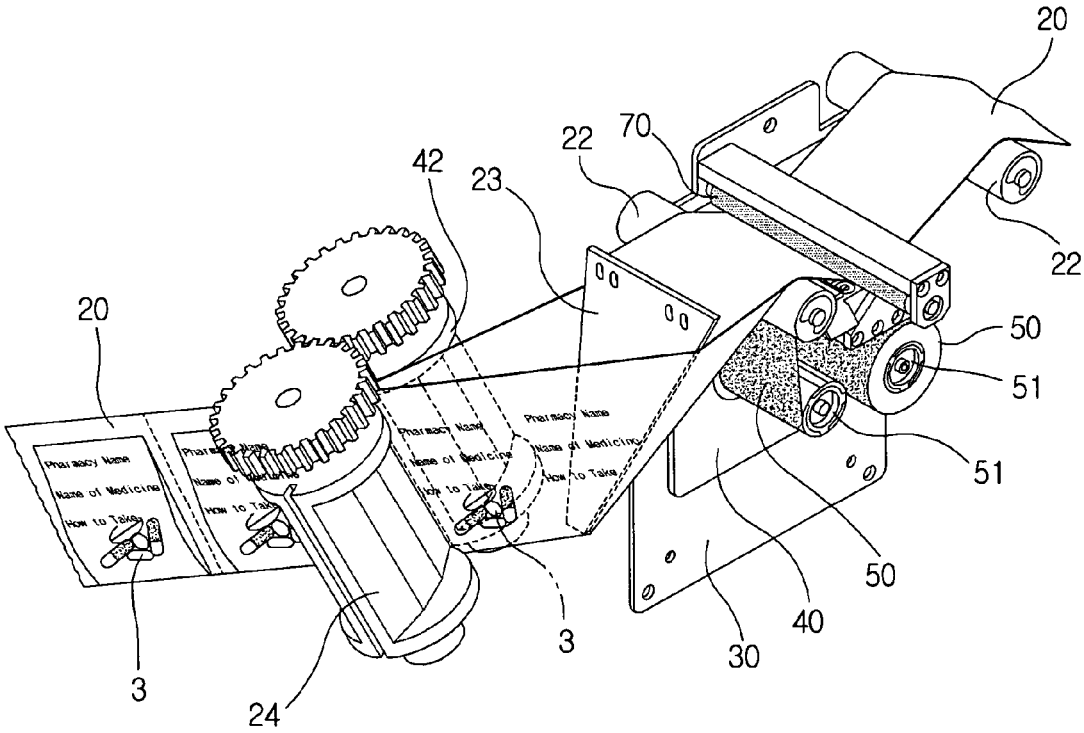
FIG. 8 is a perspective view illustrating that a printed package paper is folded in two parts and fed between sealing rollers of the package paper thermal printer according to the present invention.

As shown in FIGS. 1 to 8, a package paper thermal printer according to the preferred embodiment of the present invention includes a case 1, formed with accommodating recesses 10, for enclosing inner components of an automatic tablet packing machine, so that tablets 3 accommodated in the accommodating recesses 10 are dropped into a hopper 11 disposed under the accommodating recesses 10, and then inserted into the traveling folded package paper 20.

The package paper 20 is wound around a reel 21, folded in two by an idle roller 22 and a folding member 23, and the tablets 3 are inserted into the folded package paper 20. The folded package paper 20 is sealed at the vertical sides and the top side thereof by heat, and formed with a cutting line having a plurality of holes penetrated therethrough at the vertical sealed side of the folded package paper 20 when the folded package paper 20 travels between cylindrical sealing rollers 24 having heaters, so that the packaging is finished.

The package paper 20, in which the tablets 3 are packaged, is taken out through a discharging port 2 formed at the lower side of the case 1.

As described above, the automatic tablet packing machine for automatically inserting the tablets 3 into the package paper 20 folded in two and traveling and sealing the package paper 20 by using the sealing rollers 2, is well-know technology.

However, it is the most important characteristic of the package paper thermal printer of the tablet packing machine that the information about the prescription medicine be printed on the package paper 20 by a thermal print head 60 and the ribbon tape 50 raised and lowered when the package paper 20 is fed between the sealing rollers 24.

In other words, a supporting frame 20 made of a plate is vertically installed at the lower side of the hopper 11 toward the front side of the automatic tablet packing machine, and is formed with a quadrangular wide mounting hole 31.

An actuating plate 40 is installed at the front side of the mounting hole 31 of the supporting frame 30, so as to be raised and lowered.

Guides 31*a* are fixed to supporting plates 32 installed at sides of the mounting hole 31, and guide rails 41 formed with rail recesses 41*a* are installed at sides of the actuating plate 40.

The guides 31*a*, installed at the sides of the mounting hole 31, are inserted into the rail recesses 41*a* of the guide rails 41 of the actuating plate 40, so that the actuating plate 40 is slidably raised and lowered while being stably supported.

A driving motor 43*a* is installed at the rear lower side of the supporting frame 30, and is mounted with an eccentric cam 43 to a rotating shaft of the driving motor 43*a*. The eccentric cam 43 comes in contact with an elevating roller 33 mounted at the rear side of the actuating plate 40.

The actuating plate 40 is pulled down by a spring 42 installed at the lower side of the supporting frame 30.

Thus, when the eccentrically rotating eccentric cam 43 reaches the upper dead point so as to push up the elevating roller 33, the actuating plate is raised, and when the eccentric cam 43 further rotates and reaches the lower dead point, the actuating plate 40 is lowered due to its weight and the pulling force of the spring 42, so that the actuating plate 40 is raised and lowered at the front side of the supporting frame in the state of being stably supported.

The actuating plate 40 is mounted with wheels 51 at the front sides thereof. One end of the ribbon tape 50 is wound around one wheel 51 and the other end thereof is wound around the other wheel 51 via the upper portion of the actuating plate 40 by a plurality of guide rods 52.

A rotation shaft of a driving wheel 51 of the wheels 51 is supported by a bearing and protruded rearward of the actuating plate 40. The protruded portion of the rotation shaft is mounted with a pulley 51*b*. The pulley 51*b* is connected to a pulley 51*b* of a motor mounted at the rear side of the actuating plate 40 by a belt 51*c*, so that the driving force is transmitted to the pulleys 51*b*. When the pulleys 51*b* are rotated, the ribbon tape 50 is continuously fed to one side direction.

The supporting frame 30 is mounted with a contact roller 70 at the upper central portion thereof. The package paper 20 wound around the reel 21 is placed under the contact roller 70 and fed to the folding member 23.

The actuating plate 40 is mounted with a thermal print head 60 close to the lower surface of the ribbon tape 50 at the upper central portion thereof.

Thus, the contact roller 70, the package paper 20, the ribbon tape 50, and the thermal print head 60 are sequentially mounted from the upper portion of the actuating plate 40, and the ribbon tape 50 and the thermal print head 60 mounted at the upper portion of the actuating plate 40 are raised and lowered together.

When the actuating plate 40 is raised, the ribbon tape 50 and the thermal print head 60 disposed under the ribbon tape 40 are raised together, so that the ribbon tape 50 is closely attached to the lower surface of the package paper 20 passing the lower side of the contact roller 70 so as to support the lower surface of the contact roller. Thus, the information inputted in the thermal print head 60 is printed into readable words on the package paper 20 by thermal transfer.

The thermal print head 60 is used in the thermal printer using the thermal paper and prints characters over the thermal paper by using reaction due to heat transferred from the thermal print head 60 when the thermal paper passes on the thermal print head 60. If the package paper 20, instead of the thermal paper, but is used for printing, the ribbon tape for transferring characters by using heat is additionally used.

When the characters are inputted by an automatic sensor and a computer connected via an interface, the characters are inputted to a memory of the thermal print head 60. The thermal print head 60 transfers heat according to the shapes of the characters to be printed so as to transmit the characters to the package paper via the ribbon tape 50. Thus, various information, such as the pharmacy name, the medicine name, the patient name, how to take the medicine, or the like, can be freely printed.

As described above, when the package paper 20 wound around the reel 21 is folded in two by the folding member 23 and fed to the sealing rollers 24, and the eccentric cam 43 is rotated by the driving motor 43*a* mounted at the rear side of the supporting frame 30, the actuating plate 40 is raised causing the elevating roller 33 mounted at the rear side of the actuating plate 40 to come in contact with the eccentric cam 43, while the actuating plate 40 is stably supported by the guides 31*a* and the guide rails 41.

When the actuating plate 40 is raised as described above, the ribbon tape 50 mounted at the upper portion of the actuating plate 40 and the thermal print head 60 are raised together so as to bring the ribbon tape 50 into close contact with the lower surface of the package paper 20 passing under the contact roller 70, so that the inputted information is converted into characters and the converted character is printed on the package paper 20. Next, the printed package paper 20 is folded in two by the folding member 23 and the tablets 3 are inserted thereinto, then the printed package paper 20 is sealed by the sealing rollers 24 so that the tablet packaging is completed.

When printing of one paper bag is completed, the portion of the ribbon tape 40 where the heat has been transferred is moved while the actuating plate 40 is lowered and raised again by the eccentric cam 43. When the printed portion of the package paper 20 has been moved, the thermal print head 60 and the ribbon tape 50 are raised together again so as to perform printing. Thus, the information can be continuously printed on the package paper 20.

Meanwhile, when the actuating plate 40 and the ribbon tape 50 are raised together, since the ribbon tape 50 wound between both wheels 51 is located at the lower position by being spaced apart from the package paper 20 and the contact roller 70 by a considerable distance, the wheels 51 and the ribbon tape 50 are fully exposed so that the ribbon tape 50 is easily exchanged.

As described above, according to the present invention, since the information is continuously printed on the package paper 20 passing under the contact roller 70, while the ribbon tape 50, mounted at the upper portion of the actuating plate 40 being raised and lowered by the eccentric cam 43 rotated by the driving motor 43*a*, and the thermal print head 60 are raised together, the information can be automatically printed on the package paper 20 in the tablet packing machine so as to realize a perfect automatic tablet packing machine. Moreover, since various characters can be freely inputted to the thermal print head 60 connected to the computer via the interface so as to print various information on the package paper 20, the information about the prescription medicine is very easily printed and the patient can easily recognize the information about the prescription medicine. Hence, the competitiveness of the automatic tablet packing machine is increased.

Further, since various information, such as the pharmacy name, the medicine name, the patient's name, how to take the medicine, or the like, changed based on the kind of medicine, can be easily changed and inputted to the thermal print head 60 so as to continuously print the information, whenever the information is changed even when the package paper 20 is continuously fed and the packaging process is being performed, a user can be provided with maximal convenience.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A paper package thermal printer of an automatic tablet packing machine in which when tablets, accommodated in accommodating recesses formed at the upper side of a case enclosing inner components of the automatic tablet packing machine, are fallen into a hopper disposed under the accommodating recesses, and a package paper wound around a reel and folded in two by an idle roller and a folding member is traveled, the tablets are inserted into the folded package paper, the vertical sides and the top side of the folded package paper are sealed by heat, and the sealed vertical sides of the package paper are formed with cutting lines having a plurality of holes penetrated therethrough, while the package paper passes between cylindrical sealing rollers having heaters, so as to complete the packaging of the tablets, the paper package thermal printer comprising:

a supporting frame vertically mounted in the case and formed with a mounting hole;

an actuating plate installed at the front side of the mounting hole;

guide rails installed at sides of the actuating plate;

guides installed at sides of the mounting hole, and engaged with the guide rails so as to support the actuating plate;

a driving motor installed at a rear lower side of the supporting frame and having an eccentric cam coming in contact with an elevating roller mounted at a rear side of the actuating plate so as to raise the actuating plate;

wheels mounted at front sides of the actuating plate;

a ribbon tape wound around the wheels fed by driving force transmitted from a second motor;

a contact roller installed at a front upper portion of the supporting frame; and a thermal print head installed at a front upper portion of the actuating plate; wherein the thermal print head and the ribbon tape disposed at an upper portion thereof are raised together so as to closely attach the ribbon tape to a lower surface of the package paper passing under the contact roller, so that information inputted into the thermal print head is transferred to the package paper by heat and characters are printed on the package paper when the actuating plate is raised.

2. The package paper thermal printer as set forth in claim 1, wherein one of the wheels serves as a driving wheel, and includes a rotating shaft supported by a bearing and protruded rearward of the actuating plate, and a pulley mounted around a protruded portion of the rotation shaft, the second motor installed at the rear side of the actuating plate includes a pulley mounted to the motor, the pulleys are connected to each other by a belt so that the wheels are rotated to feed the ribbon tape in a direction.

3. The package paper thermal printer as set forth in claim 1, wherein the actuating plate is connected to a spring installed at the lower side of the supporting frame to be pulled down.

* * * * *